US010125477B2

(12) United States Patent
Lin

(10) Patent No.: US 10,125,477 B2
(45) Date of Patent: Nov. 13, 2018

(54) FAUCET STRUCTURE

(71) Applicant: Jougor Sanitary Technologies Co., Ltd., Foshan, Guangdong (CN)

(72) Inventor: Xiaozu Lin, Guangdong (CN)

(73) Assignee: Jougor Sanitary Technologies Co., Ltd. (CN)

( * ) Notice: Subject to any disclaimer, the term of this patent is extended or adjusted under 35 U.S.C. 154(b) by 0 days.

(21) Appl. No.: 15/006,087

(22) Filed: Jan. 25, 2016

(65) Prior Publication Data

US 2017/0211259 A1 Jul. 27, 2017

(51) Int. Cl.
*E03C 1/04* (2006.01)

(52) U.S. Cl.
CPC ..... *E03C 1/0404* (2013.01); *E03C 1/0403* (2013.01)

(58) Field of Classification Search
CPC ..... E03C 1/0403; E03C 1/0404
USPC ..... 4/478, 678; 137/315.15, 359
See application file for complete search history.

(56) References Cited

U.S. PATENT DOCUMENTS 5,826,788 A * 10/1998 Redding ..... F16C 17/02 137/359
6,195,840 B1 * 3/2001 Pilatowicz ..... F16K 31/607 16/441
2002/0124309 A1 * 9/2002 Donath, Jr. ..... F16K 31/60 4/678
2010/0175765 A1 * 7/2010 Andersen ..... E03C 1/0404 137/615
2010/0200081 A1 * 8/2010 Fischer ..... F16K 31/607 137/359
2016/0115678 A1 * 4/2016 Lang ..... E03C 1/04 4/668

* cited by examiner

*Primary Examiner* — Christine Skubinna

(57) ABSTRACT

The present invention relates to a faucet structure comprising an installation pipe body, a valve core unit and a handle; wherein the installation pipe body comprises an installation cavity and a water cavity interconnected to each other, wherein the opening of the installation cavity is located on top; a water inlet and a water outlet connected to the water cavity; wherein the valve core unit is rotationally disposed in the installation cavity and wherein the lower end of the valve core unit extends into the water cavity; wherein the upper end of the valve core unit has a teeth column, wherein the outer side of the teeth column forms the first outer teeth; wherein the jacket of the teeth column is provided with the first teeth sleeve; wherein the inside of the first teeth sleeve forms the first inner teeth, wherein said first inner teeth is engaged with the first outer teeth; wherein the outside of the first teeth sleeve forms the second outer teeth; wherein the lower end of the handle further comprise an installation part; wherein the outside of the installation part is provided with an end cap, a bearing and a locking ring; wherein an installation hole is provided in the installation part; wherein the second teeth sleeve is fixed on the inner wall of the installation hole; wherein inside of the second teeth sleeve forms the second inner teeth, wherein the second inner teeth is engaged with the second outer teeth.

10 Claims, 4 Drawing Sheets

FAUCET STRUCTURE

BACKGROUND

Field

The present invention relates to the field of kitchen & bathroom appliance, and more particularly, to a faucet structure.

Description of Related Art

A faucet is a type of water pipe valve used in our daily life, such as in the family kitchens and bathrooms. Due to health and environmental protection concerns, copper faucets are gradually replaced by the stainless steel faucet because the lead-bearing copper faucet can be harmful to human body after long-term usage.

The handle of conventional water faucets are usually fixed directly by screws, having the disadvantages of easy-loosening, bad stability, inconvenient disassembling and maintenance.

SUMMARY OF INVENTION

Given this, the purpose of the present invention is to provide a faucet structure, which can effectively resolve issues relating to connection and stability of the conventional faucets.

In order to achieve the objectives above, the technical solution adopted in the invention, is to provide a faucet structure, comprising an installation pipe body, a valve core unit and a handle; wherein the installation pipe body comprises an installation cavity and a water cavity interconnected to each other, wherein the opening of the installation cavity is located on top; wherein a water inlet and a water outlet are connected to the water cavity, wherein the water inlet and the water outlet are located at the lower end of the installation pipe body; wherein the valve core unit is rotationally disposed in the installation cavity and wherein the lower end of the valve core unit extends into the water cavity; wherein the upper end of the valve core unit has a teeth column, wherein the outer side of the teeth column forms the first outer teeth; wherein the jacket of the teeth column is provided with the first teeth sleeve, wherein said teeth sleeve is fixed to the teeth column through a screw; wherein the inside of the first teeth sleeve forms the first inner teeth, wherein said first inner teeth is engaged with the first outer teeth; wherein the outside of the first teeth sleeve forms the second outer teeth; wherein the lower end of the handle further comprise an installation part; wherein the outside of the installation part is provided with an end cap, a bearing and a locking ring; wherein the bearing is disposed between front of the end cap and the locking ring; wherein the end cap is fixed to the upper end of the installation pipe body; wherein an installation hole is provided in the installation part; wherein the second teeth sleeve is fixed on the inner wall of the installation hole; wherein inside of the second teeth sleeve forms the second inner teeth, wherein the second inner teeth is engaged with the second outer teeth.

It is preferred that the outer side of the installation pipe body forms the outer screw teeth.

It is preferred that the first inner screw teeth are provided on the water inlet and the second inner screw teeth are provided on the water outlet.

It is preferred that the first screw part is provided on the installation pipe body and the second screw part, which is coupled with the first screw part, is provided on the valve core unit.

It is preferred that the third screw part is provided on the upper end opening of the installation pipe body and the fourth screw part, which is coupled with the third screw part, is provided on the end cap. In addition, a gasket is placed between the end cap and the upper end face of the installation pipe body.

It is preferred that a cover plate, which is placed between the handle and the surface of the end cap, is further provided on the installation part, and a sealing ring is placed between the handle and the surface of the cover plate.

Comparing with the prior art, the present invention has obvious advantages and beneficial effects. Specifically, the above technical solution proves that by providing a teeth column and a teeth sleeve, utilizes the engagement of the inner teeth and the outer teeth to simplify and stabilize the location and installation of the handle. This installation structure has advantages of difficult loosening, long life-span, convenient disassembling and maintenance, which bring great convenience for users.

To clearly expound on the structure characteristics and efficacy of the present invention, the drawings and embodiment provide hereinafter are combined to illustrate the present invention.

MARKING INSTRUCTION OF THE DRAWINGS

| | |
|---|---|
| 10. Installation Pipe Body | 11. Installation Cavity |
| 12. Water Cavity | 13. Water Inlet |
| 14. Water Outlet | 15. Outer Screw Teeth |
| 16. The First Inner Screw Teeth | 17. The Second Inner Screw Teeth |
| 18. The First Screw Part | 19. The Third Screw Part |
| 20. Valve Core Unit | 21. Teeth Column |
| 211. The First Outer Teeth | 22. The Second Screw Part |
| 30. Handle | 31. Installation Part |
| 32. Installation Hole | 41. The First Teeth Sleeve |
| 411. The First Inner Teeth | 412. The Second Outer Teeth |
| 42. Screw | 43. End Cap |
| 431. The Fourth Screw Part | 44. Bearing |
| 45. Locking Ring | 46. The Second Teeth Sleeve |
| 461. The Second Inner Teeth | 47. Gasket |
| 48. Cover Plate | 49. Sealing Ring |

DETAILED DESCRIPTION

The technical solution adopted in the invention can be further illustrated in details by the following embodiments.

Figure 1:
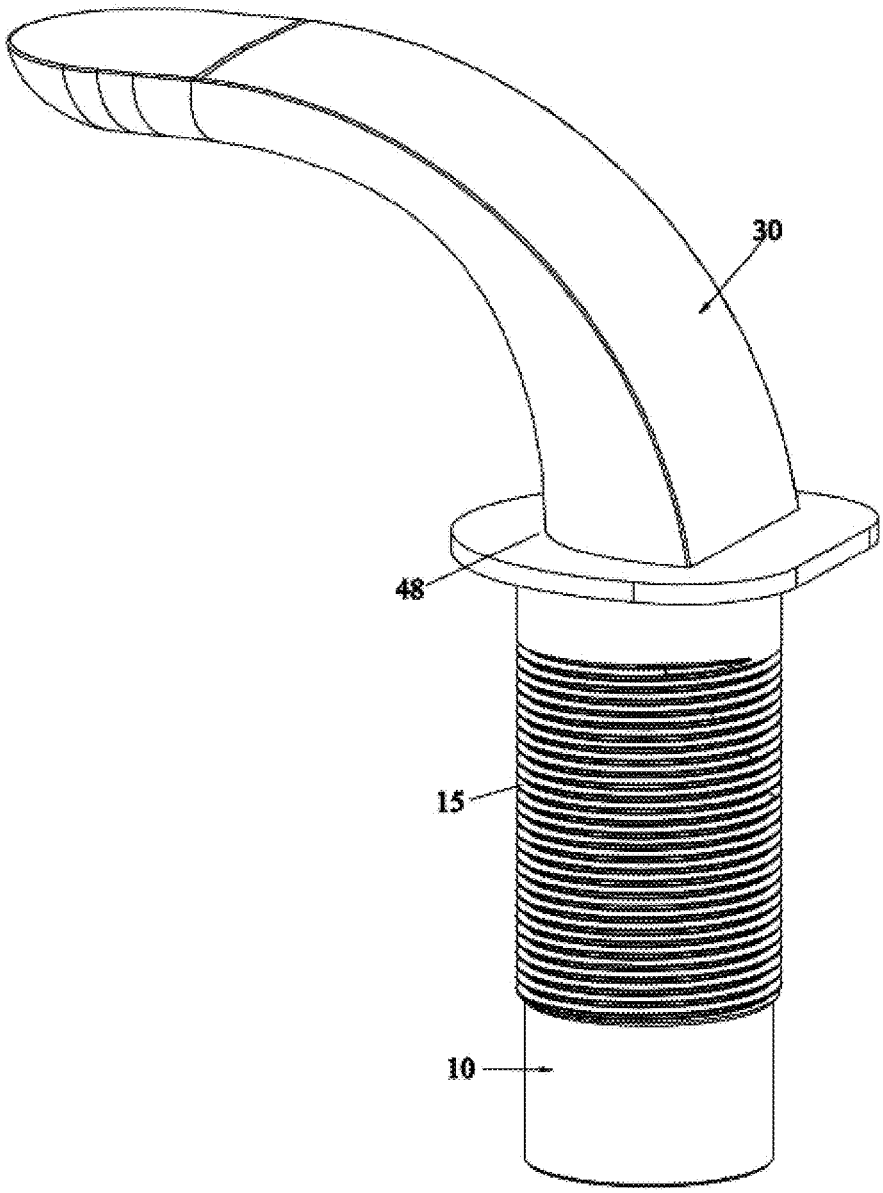
FIG. 1 is a three-dimensional assembly schematic diagram of a preferred embodiment of the present invention.
Figure 2:
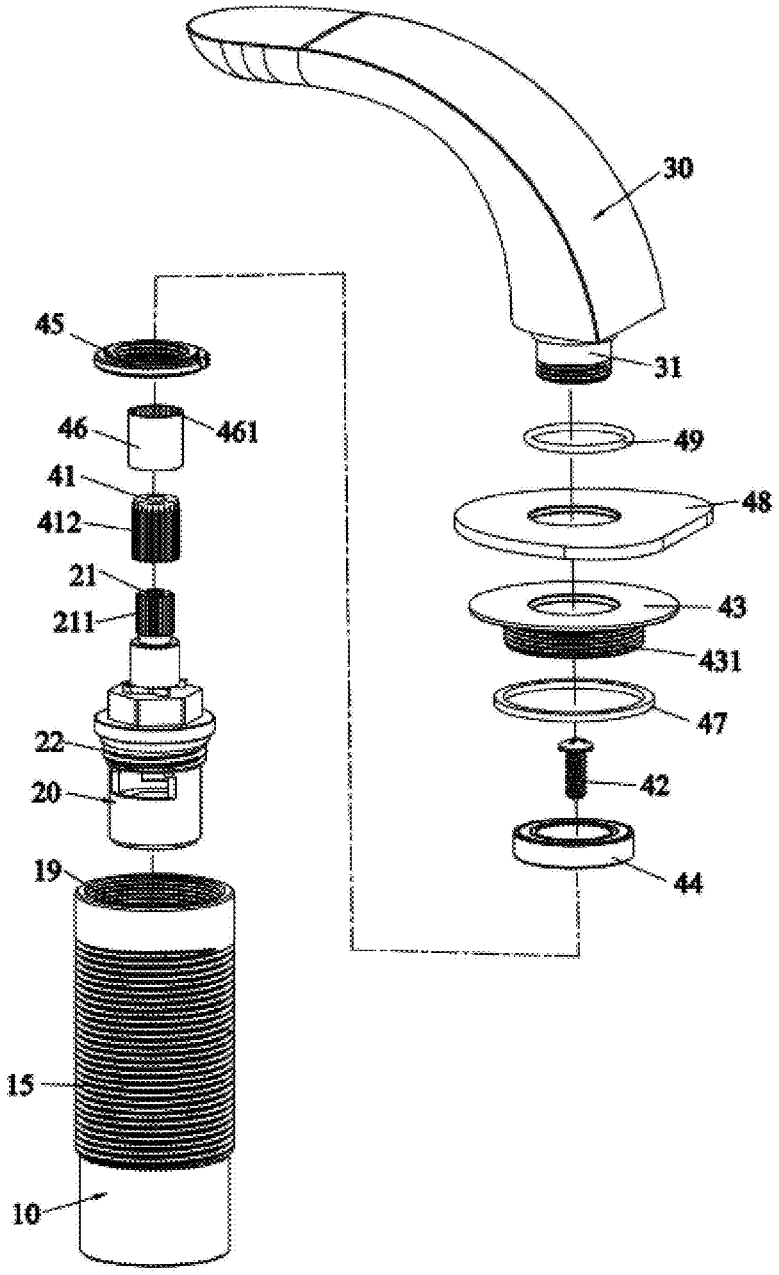
FIG. 2 is an exploded view of a preferred embodiment of the present invention.
Figure 3:
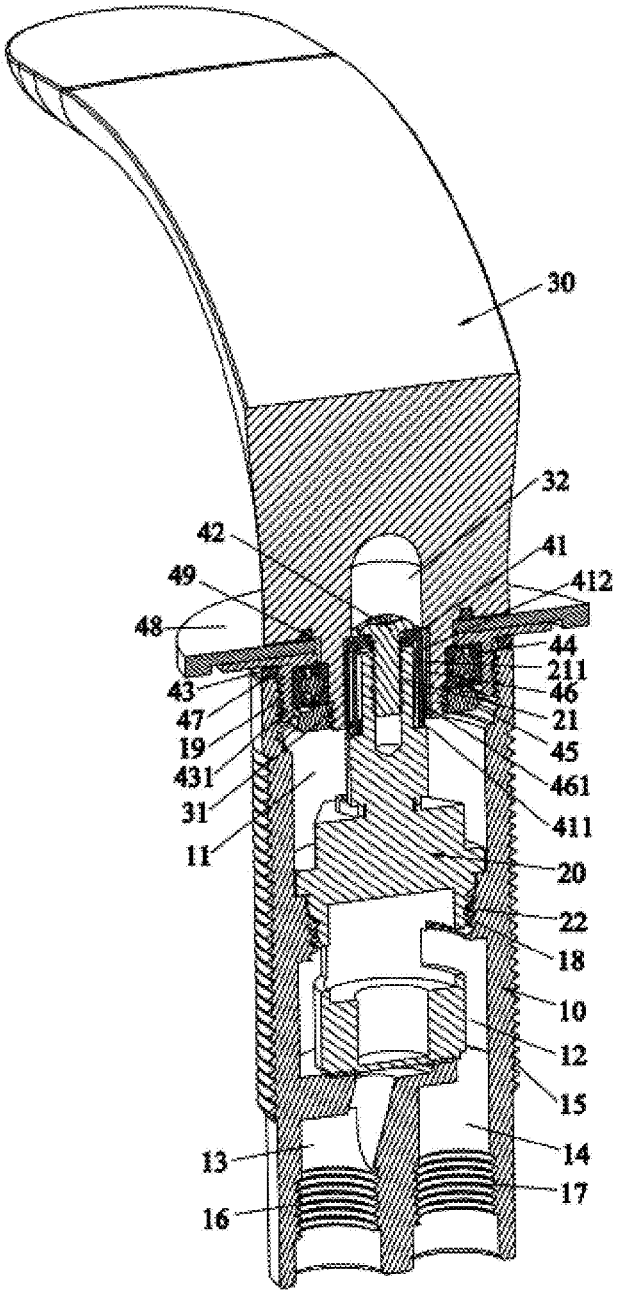
FIG. 3 is a sectional view of a preferred embodiment of the present invention.
Figure 4:
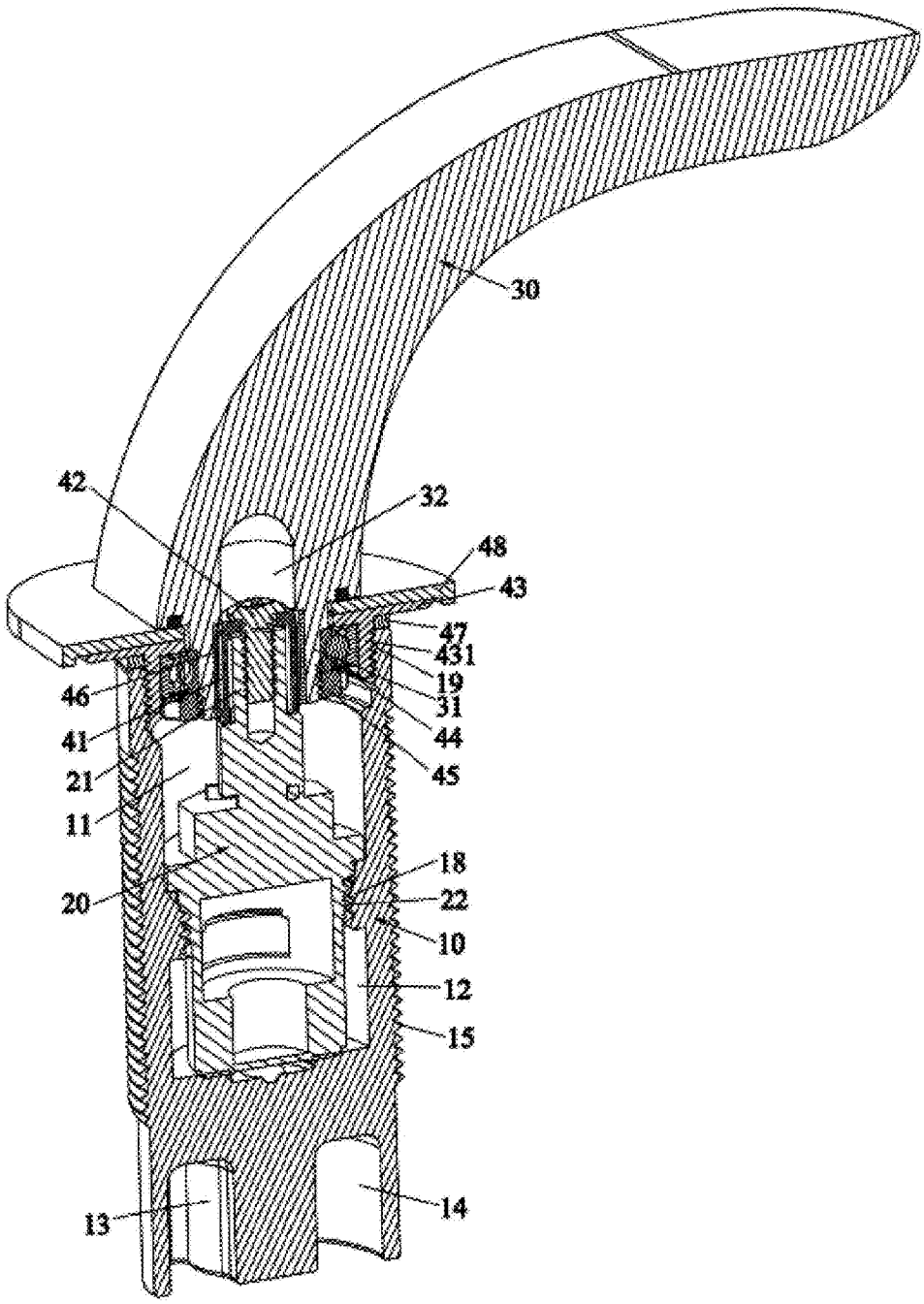
FIG. 4 is another sectional view of a preferred embodiment of the present invention.

As shown in FIG. 1 to FIG. 4, the preferred embodiment of the present invention comprises the installation pipe body 10, the valve core unit 20 and the handle 30.

The installation pipe body 10 has an installation cavity 11 and a water cavity 12, which are interconnected with each other; the opening of the installation cavity 11 is on top of the installation cavity; a water inlet 13 and a water outlet 14 are connected to the water cavity 12, and are provided at the lower end of the installation pipe body 10. In this embodiment, the outer side of the installation pipe body 10 forms the outer screw teeth 15, additionally, the first inner screw teeth 16 is provided on the water inlet 13 and the second inner screw teeth 17 is provided on the water outlet 14 in order to connect to external installation conveniently.

The valve core unit 20 is rotationally installed in the installation cavity 11 and the lower end of the valve core unit 20 extends into the water cavity 12; the upper end of the valve core unit has a teeth column 21, of which the outer side forms the first outer teeth 211; the jacket of the teeth column 21 is provided with the first teeth sleeve 41, which is fixed to the teeth column 21 through the screw 42; inside of the first teeth sleeve 41 forms the first inner teeth 411, which is engaged with the first outer teeth 211; outside of the first teeth sleeve 41 forms the second outer teeth 412. In this embodiment, the first screw part 18 is provided in the installation pipe body 10 and the second screw part 22, which is coupled with the first screw part 18, is provided to the valve core unit 20.

The lower end of the handle 30 has an installation part 31; outside of the installation part 31 is provided with an end cap 43, a bearing 44 and a locking ring 45; the bearing 44 is placed between front of the end cap 43 and the locking ring 45; the end cap 43 is fixed to the upper end of the installation pipe body 10; the installation hole 32 is provided on the installation part 31; the second teeth sleeve 46 is fixed on the inner wall of the installation hole 32; the inside of the second teeth sleeve 46 forms the second inner teeth 461, which is engaged with the second outer teeth 412. In this embodiment, the third screw part 19 is provided in the upper end opening of the installation pipe body 10 and the fourth screw part 431, which is screwed with the third screw part 19, is provided in the end cap 43. Additionally, a gasket 47 is sandwiched between the end cap 43 and the upper end face of the installation pipe body 10.

Furthermore, a cover plate 48, which is placed between the handle 30 and the surface of the end cap 43, is further provided to the installation part 31, and a sealing ring 49 is sandwiched between the handle 30 and the surface of the cover plate 48.

The design of the invention focuses on providing a teeth column and a teeth sleeve, utilizing the engagement of the inner teeth and the outer teeth to simplify and stabilize the location and installation of the handle. This installation structure has advantages of stability, long life-span and convenient disassembling and maintenance operation, which bring great advantages for users.

The above description combined with detailed embodiment to elaborate the technical principles of the invention. The description is intended to illustrate, but not to limit the protective scope of the invention in any way. Based on the detailed description herein, those skilled in the art can associate themselves with other particular embodiments without paying creative labor. Thus, these embodiments shall fall into the protective scope of the invention.

The invention claimed is:

1. A faucet structure, comprising:

an installation pipe body, a valve core unit and a handle;

wherein the installation pipe body further comprising an installation cavity and a water cavity interconnected to each other, wherein an opening of the installation cavity is located on a top; wherein the water cavity is located below the installation cavity, wherein the valve core unit is rotationally disposed in the installation cavity and wherein a lower end of the valve core unit extends into the water cavity;

wherein an upper end of the valve core unit further comprising a teeth column, wherein a first outer teeth is formed on an outer side of the teeth column; wherein a first teeth sleeve is disposed concentrically outside the teeth column and connected to the teeth column through a screw, wherein a first inner teeth is formed on an inner side of the first teeth sleeve, wherein said first inner teeth is engaged with the first outer teeth; wherein a second outer teeth is formed on an outer side of the first teeth sleeve;

wherein a third screw part is formed at an upper end of the installation pipe body;

wherein a fourth screw part is formed at a lower end of the installation part;

wherein a lower end of the handle further comprising an installation part; wherein an end cap, a bearing and a locking ring are disposed concentrically outside the installation part; wherein the bearing is disposed between the end cap and the locking ring; wherein the lower end of the installation part extends pass the lower end of the end cap; wherein the locking ring couples a lower end of the installation part to a lower portion of the third screw part; wherein the end cap is fixed to the installation pipe body by coupling the fourth screw part with an upper portion of the third screw part;

wherein an installation hole is provided in the installation part; wherein a second teeth sleeve is fixed on the inner wall of the installation hole; wherein a second inner teeth is disposed inside the second teeth sleeve, wherein the second inner teeth is engaged with the second outer teeth.

2. The faucet structure of claim 1, wherein an outer teeth is formed on an outer side of the installation pipe body.

3. The faucet structure of claim 1, wherein the first inner teeth is provided in the water inlet and the second inner teeth is provided in the water outlet.

4. The faucet structure of claim 1, wherein the first screw part is provided on the installation pipe body and the second screw part is provided on the valve core unit, wherein the first screw part and the second screw part are coupled with each other.

5. The faucet structure of claim 1, wherein a gasket is disposed between the end cap and an upper end face of the installation pipe body.

6. The faucet structure of claim 1, wherein a cover plate is disposed between the handle and a surface of the end cap, wherein said cover plate is provided on the installation part, and wherein a sealing ring is disposed between the handle and a surface of the cover plate.

7. A faucet structure, comprising:

an installation pipe body, a valve core unit and a handle;

wherein a lower end of the handle further comprising an installation part, wherein thread is formed on an outer side of a lower end of the installation part, wherein a third screw part is formed on an inner side of an upper end of the installation pipe body, wherein an end cap, a bearing and a locking ring are disposed concentrically outside the installation part; wherein the bearing is disposed between the end cap and the locking ring;

wherein a fourth screw part is formed on an outer side of a lower end of the end cap, wherein the diameter of the installation part is smaller than the diameter of the fourth screw part, wherein the diameter of the fourth screw part is smaller than the diameter of the third screw part, wherein the fourth screw part couples with an upper portion of the third screw part to connect the end cap to the installation pipe body;

wherein the lower end of the installation part extends pass the lower end of the end cap; wherein the locking ring couples the thread formed at the lower end of the installation part to a lower portion of the third screw part;

wherein the installation pipe body further comprising an installation cavity and a water cavity interconnected to each other, wherein an opening of the installation cavity is located on top; wherein the water cavity is located below the installation cavity; wherein the valve core unit is rotationally disposed in the installation cavity and wherein a lower end of the valve core unit extends into the water cavity.

8. The faucet structure of claim 7, wherein a first screw part is provided on the installation pipe body and a second screw part is provided on the valve core unit, wherein the first screw part and the second screw part are coupled with each other to divide the installation pipe body into the water cavity and the installation cavity.

9. The faucet structure of claim 7, wherein a gasket is disposed between the end cap and an upper end face of the installation pipe body.

10. The faucet structure of claim 1, wherein a cover plate is disposed between the handle and a surface of the end cap, wherein said cover plate is provided on the installation part, and wherein a sealing ring is disposed between the handle and a surface of the cover plate.

* * * * *